US005868067A

United States Patent [19]

Patton et al.

[11] Patent Number: 5,868,067

[45] Date of Patent: Feb. 9, 1999

[54] FIBER AND TRASH BALER

[76] Inventors: Robert Patton, 53 Tallow Ct., Lake Jackson, Tex. 77566; David A. Gillespie, 208 Riveredge Dr., Spartanburg, S.C. 29301

[21] Appl. No.: 56,068

[22] Filed: Apr. 7, 1998

[51] Int. Cl.[6] ..... B30B 15/22; B30B 9/30

[52] U.S. Cl. ..... 100/50; 100/249; 100/269.08; 100/269.14

[58] Field of Search ..... 100/48, 50, 52, 100/240, 245, 249, 250, 269.06, 269.07, 269.08, 269.1, 269.14

[56] References Cited

U.S. PATENT DOCUMENTS 1,020,176 3/1912 Astfalck ..... 100/269.1
3,603,245 9/1971 Pioch ..... 100/269.1
3,693,541 9/1972 Lombard et al. ..... 100/52
4,057,010 11/1977 Smith ..... 100/50
4,080,889 3/1978 Shiloni ..... 100/52

*Primary Examiner*—Stephen F. Gerrity
*Attorney, Agent, or Firm*—John Lezdey & Assoc

[57] ABSTRACT

A baler for compacting fibrous materials or other compactable materials having a platen operable by two compression devices. One compression device is at least one hydraulic cylinder with a piston rod attached to the platen which performs compaction. The other compression device is at least one hydraulic cylinder with a piston rod which is attached to the platen and performs tramping. The apparatus provides rapid tramping before compaction by the selective activation of only the second compression device. Both cylinders function through a common hydraulic fluid reservoir and solenoid valve.

13 Claims, 7 Drawing Sheets

FIBER AND TRASH BALER

FIELD OF THE INVENTION

The present invention relates to a baler for fibers and other compactable materials such as trash. More particularly, there is provided a compaction apparatus and method wherein at least two hydraulic cylinders are attached to a platen which precompacts and compresses the fibers or other compactable materials in a single baling box.

BACKGROUND OF THE INVENTION

Fibers balers are necessary for the reason that all types of fibers exhibit very low apparent densities unless they are compacted and constrained. This compaction allows more efficient storage and shipping of the fiber, since the compacted form of the fiber takes up less volume, requires less warehouse space, and fewer containers or vehicles to transport. Other materials besides fiber also exist naturally in a low density form and share in the need for compaction and constraint for the same reasons as fiber. Such materials include paper, cardboard, wood shavings, refuse and metal shavings, just to name a few. The art of baling is well known and many different types of balers exist today. These balers all share some common features. They have one or more compaction boxes for the material to be baled, a hydraulic ram to provide the compaction energy, and a platen to provide the uniform pressure across the entire cross section of the bale. Additionally, they provide some means for allowing bands, straps or wires to be employed and secured around the bales after the material has been sufficiently compacted, but before the pressure is released from the bale.

Using existing art, if the baler has only one compaction box and no precompaction device, the output of the baler is relatively low. The reason for this is that the platen is connected to a hydraulic ram, and the rate at which the hydraulic ram can move is proportional to the volumetric output of the hydraulic pump which powers the ram. The primary purpose of this hydraulic pump is, of course, to provide high pressure to move the platen just far enough during the final compaction cycle that the bale is compacted to the desired density. In single compaction box with no precompaction equipment though, a secondary purpose of this hydraulic pump is to provide the energy and pressure necessary to accomplish, in several steps, precompaction of successive charges of fiber or material to an intermediate density allowing the box to be filled before the final compaction occurs. Each one of these compaction steps is slow because the ram moves only at a rate determined by the volumetric capacity of the hydraulic pump. Not only is each of the compaction steps slow, but the retraction of the ram is slow as well, because it too, is determined by the volumetric capacity of the hydraulic pump. Single box balers without trampers usually, but not always, have the compression box in a horizontal orientation.

To increase the output associated with a single hydraulic system, and associated single ram, single platen, and single compaction box, the known art of baling has come to include a variety of different types of precompaction devices. These precompaction devices, often known as trampers, are typically used on fiber and consist of metal boxes with some type of tramper foot. Because of the much greater volume of material handled, the tramping step is usually more time consuming, per pound of material handed, than the final compaction step, so several precompacting devices are often used to feed multiple high pressure boxes. Once loaded, however, the boxes are moved under a single platen and hydraulic ram for the final compaction step. In this manner, the most costly components of the baler are kept in more continuous use, and are therefore used to better effect.

U.S. Pat. No. 4,936,206 to Miles et al discloses a compacting apparatus having a compression chamber defined by side plates and first and second movable end platens, a long stroke small diameter hydraulic piston pushes the first end platen against a charge toward the second end plate, partially compressing the charge. The first end platen is then latched in a fixed position while the second end platen by the short-stroke large diameter hydraulic piston applies a further compressive stroke. The fully compressed charge is pushed out of the compression chamber bound loosely while fully compressed.

U.S. Pat. No. 3,451,190 to Tezuka discloses a device having four hydraulic cylinders for compacting trash and garbage to remove liquid. There are additional cylinders for actuation of gates and wrapping equipment.

U.S. Pat. Nos. 3,384,007; 3,621,775; 4,953,458 and 5,325,770 are typical of prior art compaction devices. However, none of the patents show the use of primary and a secondary hydraulic cylinders to move a platen to accomplish both tramping and final compaction.

SUMMARY OF THE INVENTION

The invention provides an apparatus for compressing compactable materials of low density. The apparatus comprises a housing having a charge inlet and means in the housing defining a compression chamber which extends along a fixed longitudinal or horizontal axis. The chamber is defined by sidewalls, a rear wall and a platen moveable along the axis defining a front wall. At least two compression means are mounted in the housing and are attached to and extending from the platen for axial compression of a charge against the rear wall. The compression means comprises a first hydraulic cylinder and piston rod attached to and carried by the platen and a second compression means which is at least one hydraulic cylinder and associated piston rod which operates faster than said first hydraulic cylinder and piston rod. The piston rod of the second compression means is also connected to the platen. The second hydraulic cylinder can work alone or together with the first hydraulic cylinder. A result of the separate and faster action of the second compression means permits rapid tramping of the charge several times before final compaction.

Advantageously, a plurality of the apparatus can be linked together to provide multiple baling.

It is understood that the present apparatus can be a horizontal or vertical baler. The horizontal baler is illustrated only for a better understanding of the invention. Also, the apparatus can be one or more aligned balers.

It is therefore an object of the invention to provide an apparatus for compressing compactible materials such as fibrous materials and trash.

It is another object of the invention to provide a baler capable of rapidly and repeatedly tramping successive charges of material.

It is a further object of the invention to provide a baler capable of tramping and/or compressing a charge of material.

It is still another object of the invention to provide a baler having a single compaction box, a single hydraulic system and a single platen to be used to accomplish both tramping and final compaction of fibrous material.

DESCRIPTION OF THE PREFERRED EMBODIMENTS

Figure 1:
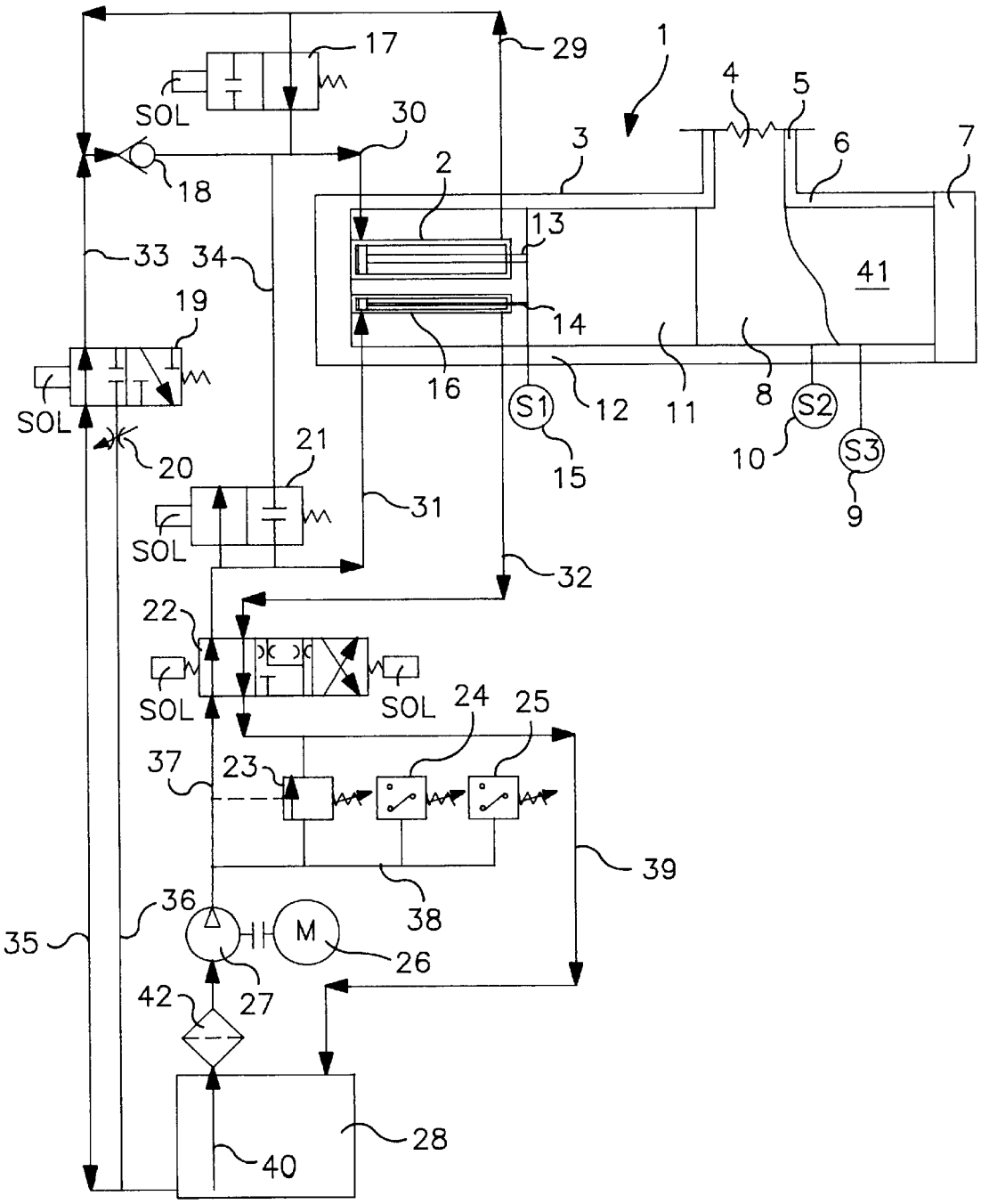
FIG. 1 is a schematic diagram of the baler of the invention in an initial tramping compaction cycle.

As shown in FIGS. 1 through 7 of the drawings, there is provided a baler or compaction apparatus 1 for fiber or trash comprising a housing 3 having an inlet 5 into which a low density charge of fibrous material or trash 4 can be placed. The housing 3 has a longitudinal chamber 41 formed by side walls 6, 12, a rear wall or door 7, and a platen 11. The platen 11 defines the front wall of the chamber 41 and is movable in a fixed longitudinal axis by compression means to tramp and/or compact the fibrous material or trash 4.

The compression means comprises a primary hydraulic cylinder 2 and a faster acting secondary hydraulic cylinder 16, both of which are attached to the platen 11. The platen 11 may be energized by either the secondary cylinder 16 alone for tramping and retraction cycles or both the secondary cylinder 16 and the primary cylinder 2 for tramping and retraction cycles or both the secondary cylinder 16 and the primary cylinder 2 simultaneously for the compaction cycle.

As shown in FIG. 1, the initial tramping cycle starts with the compression chamber 41 empty, and the fiber or other feedstock falls through the inlet into the chamber. The baling process is started by energizing the motor 26 which drives the hydraulic pump 27. Once a charge of untramped fiber has fallen into the compression chamber, the three position, four-connection, spring-centered solenoid valve 22 permits direct flow of hydraulic fluid to and from the actuating cylinders in a mode which causes the platen 11 to move in the compression direction. However, the two-position, two-connection spring-offset solenoid valve 21 blocks the flow of high pressure hydraulic fluid from the pump discharge to the primary cylinder 2, and the two-position, two-connection spring-offset solenoid valve 17 opens to allow hydraulic fluid flow from one end of the primary cylinder to the other end. Thus, the platen 11 is extended rapidly and the primary hydraulic cylinder 2 requires no hydraulic fluid from the pump 27. During this extension cycle, the fluid requirement to one end of the main cylinder is greater than the fluid flow from the other end. This make-up fluid flows with little restriction from the hydraulic fluid reservoir 28 through the two-position, four-connection spring-offset solenoid valve 19. Some of this make-up fluid flows through the check valve 18 and some flows through the solenoid valve 17.

Figure 2:
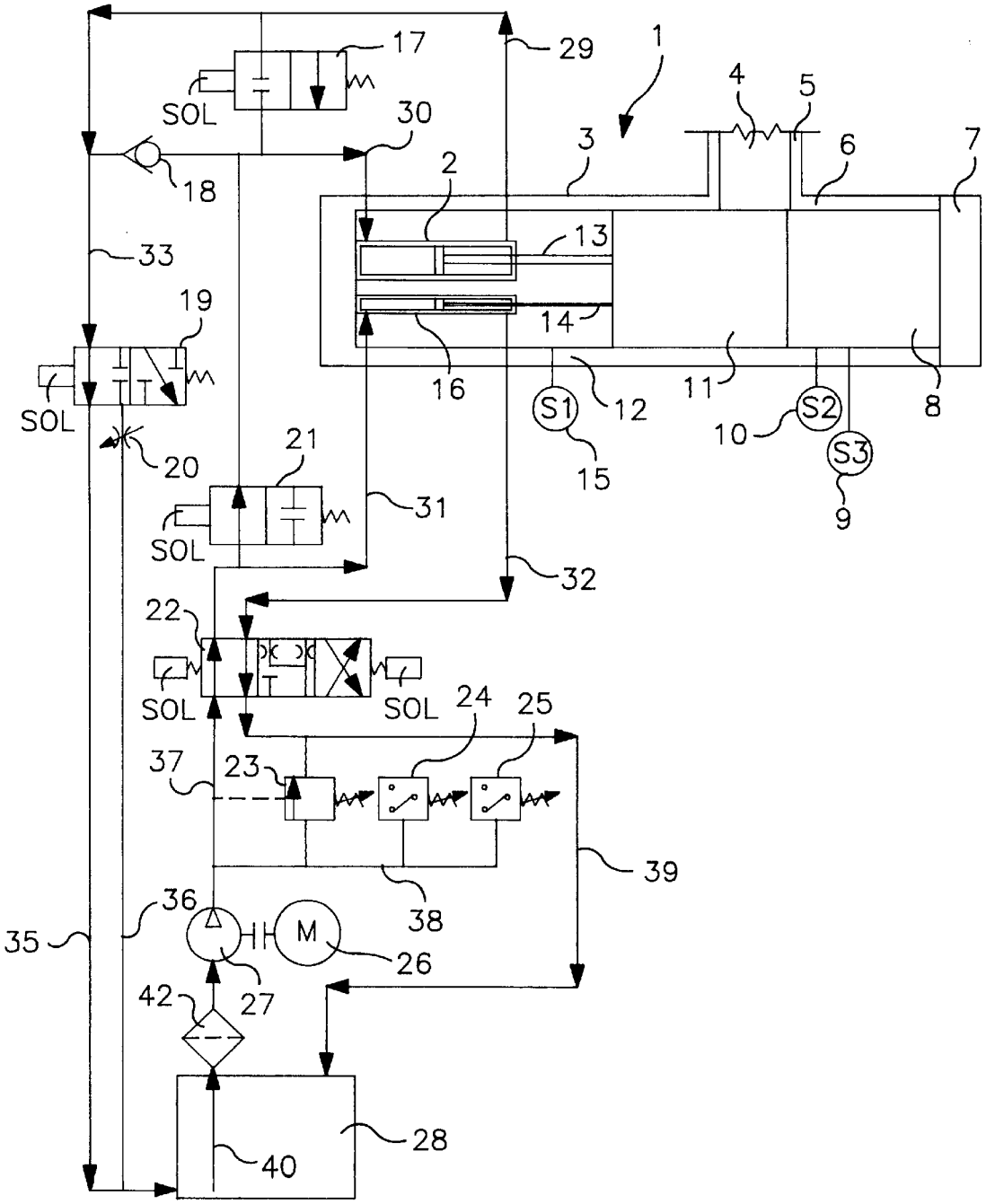
FIG. 2 is a schematic diagram of the baler of the invention in a tramping compaction cycle with the platen extended to the point where the tearing of feed material has required the main hydraulic ram to be energized.

FIG. 2 shows the baler with the platen extended to the "pinch point". This "pinch point" occurs when the platen approaches the opposing side of the inlet. The feedstock is pinched between the platen 11 and the opposing inlet wall 7 until the fiber or other material is torn or cut in two. If the feedstock strongly resists cutting or tearing, it causes the pressure to rise in the secondary cylinder 16 and thus the hydraulic pump 27 is required to provide more pressure. The pressure will rise only until the high pressure switch 24 is actuated, and this causes solenoid valves 17 and 21 to move to the positions shown. This directs high pressure hydraulic fluid to the primary cylinder 2 and shunts the cylinder discharge fluid back to the reservoir 28 through solenoid valve 19. The result of this sequence of events is that the motivating force against the platen 11 is greatly increased and the platen's extension rate is greatly diminished. This mode of operation continues until the hydraulic fluid pressure drops to a point where the secondary cylinder 16 can again move the platen 11 without assistance from the primary cylinder. This lowered pressure is sensed by low pressure switch 25 which causes solenoid valves 17 and 21 to again switch positions, stopping pressurized hydraulic fluid flow to the primary cylinder 2 and bypassing the fluid flow from one end of the cylinder to the other.

Figure 3:
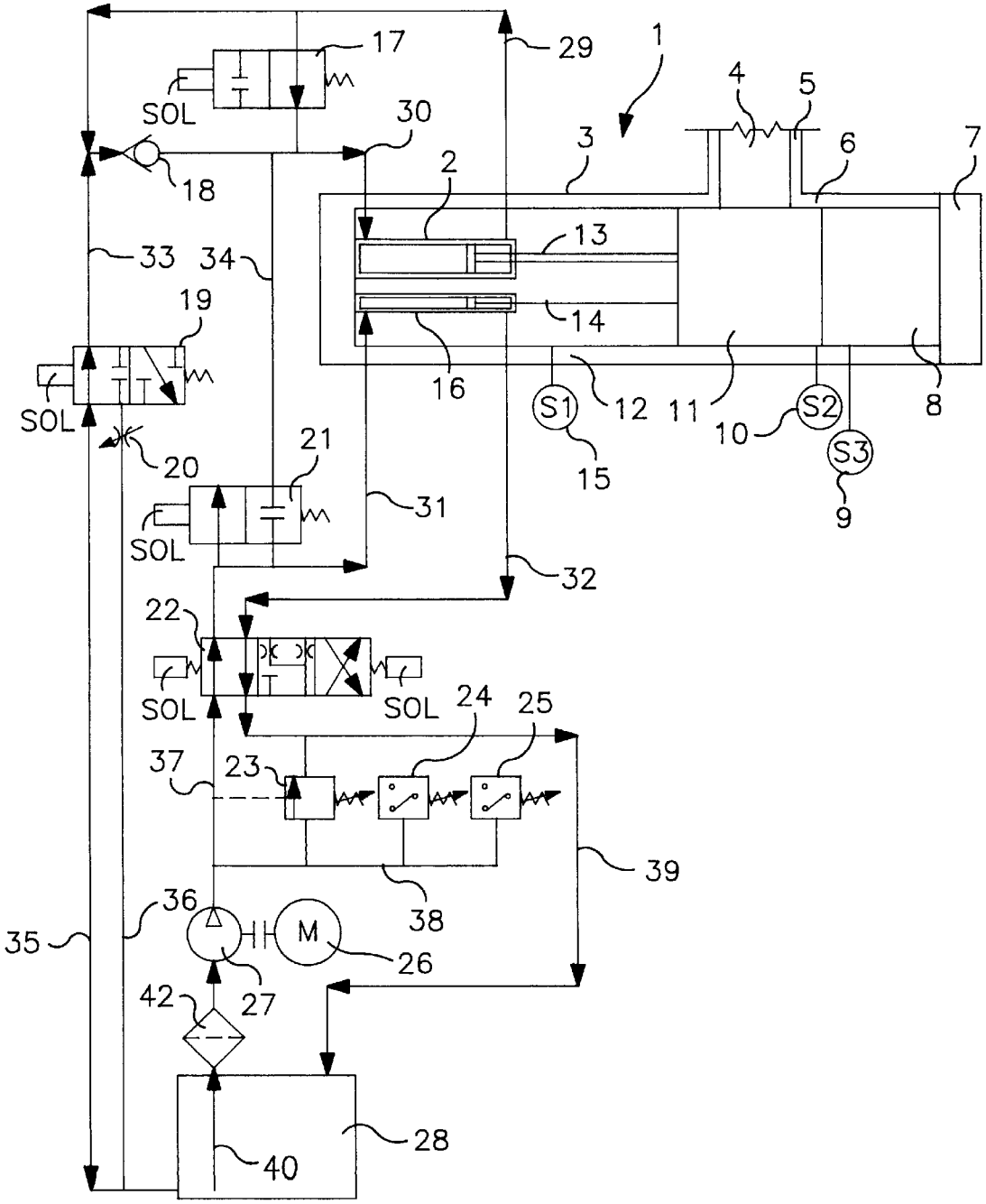
FIG. 3 is a schematic diagram of the baler of the invention in the fast extension tramping cycle with the platen extended past the feedstock pinch point.
Figure 4:
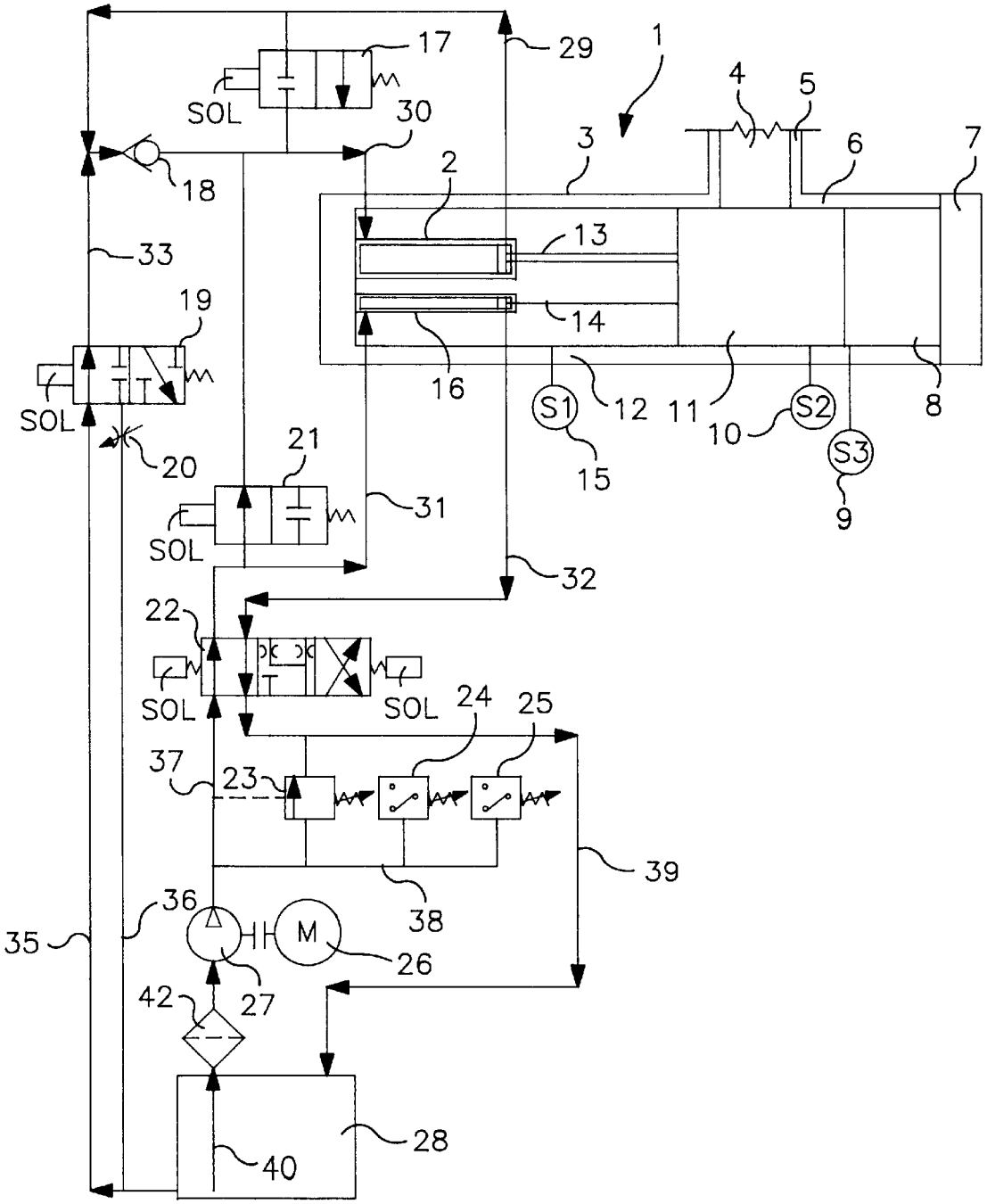
FIG. 4 is a schematic diagram of the baler of the invention with the main hydraulic ram energized in the high pressure compaction cycle.
Figure 5:
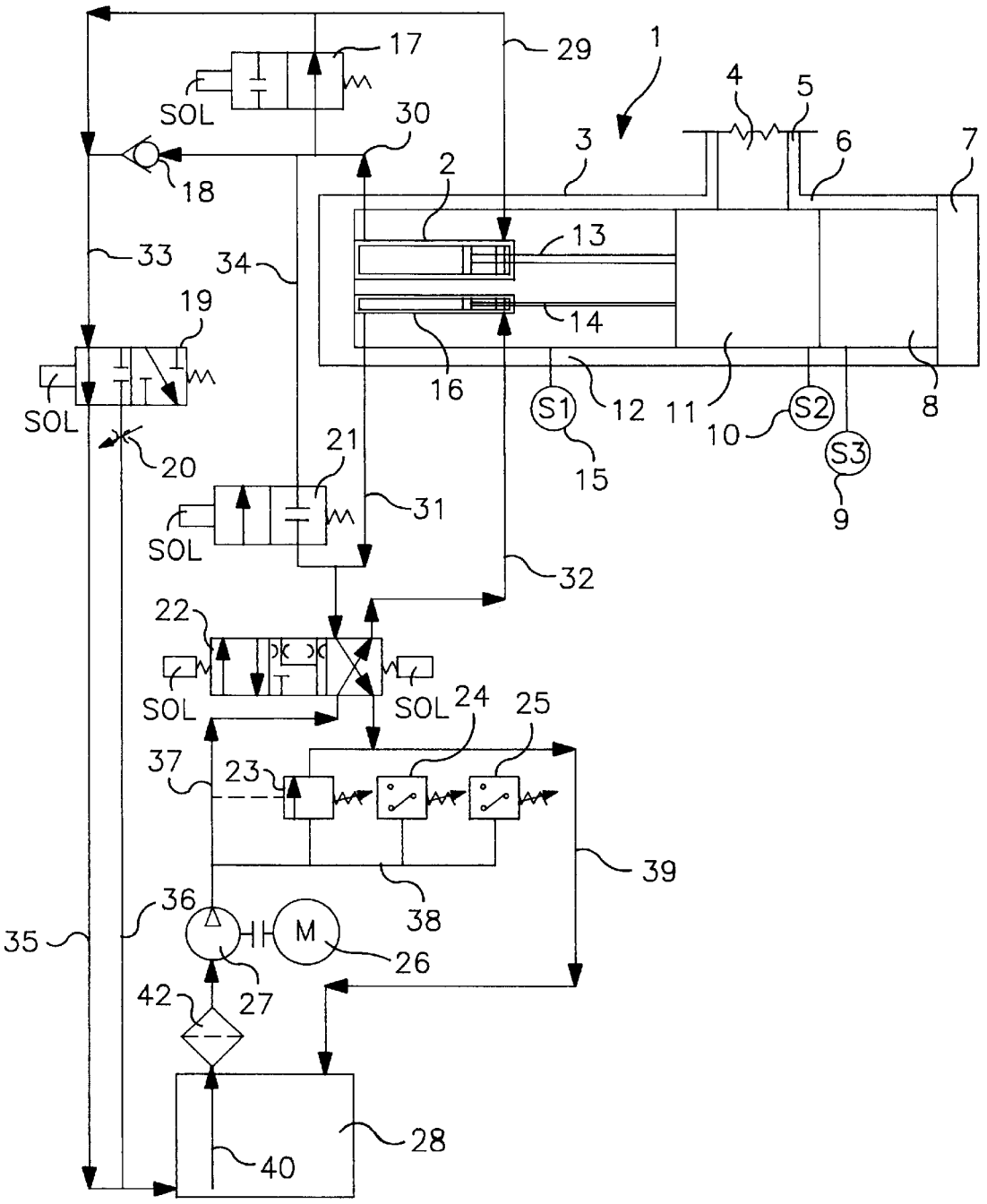
FIG. 5 is a schematic diagram of the baler of the invention in the retraction cycle.

FIG. 3 shows the platen 11 extending past position switch S2 (10) with all pressurized hydraulic fluid directed to the faster moving secondary cylinder 16. If the platen 11 is extended past the position switch S2 before the hydraulic pressure rises to the activation pressure of the high pressure switch 24, then the activation of this pressure switch results in the repositioning of solenoid valve 22 to cause retraction of the platen 11. If, as shown in FIG. 4, the hydraulic fluid pressure rises to the activation point of high pressure switch 24 before the platen 11 reaches position switch S2, then solenoid valves 17 and 21 are reversed so as to activate the primary cylinder 2. This mode of operation continues until the platen 11 is extended to position switch S3 (9). This causes solenoid valves 17, 21 and 22 to all reverse and the retraction of the platen 11 to begin as shown in FIG. 5. If, however, the high pressure switch 24 is again activated before the platen 11 reaches position switch S3 (9) the platen is stopped in this position and an alarm is sounded to signal the operator to put the bale straps in place around the compressed material thus held in place.

Figure 6:
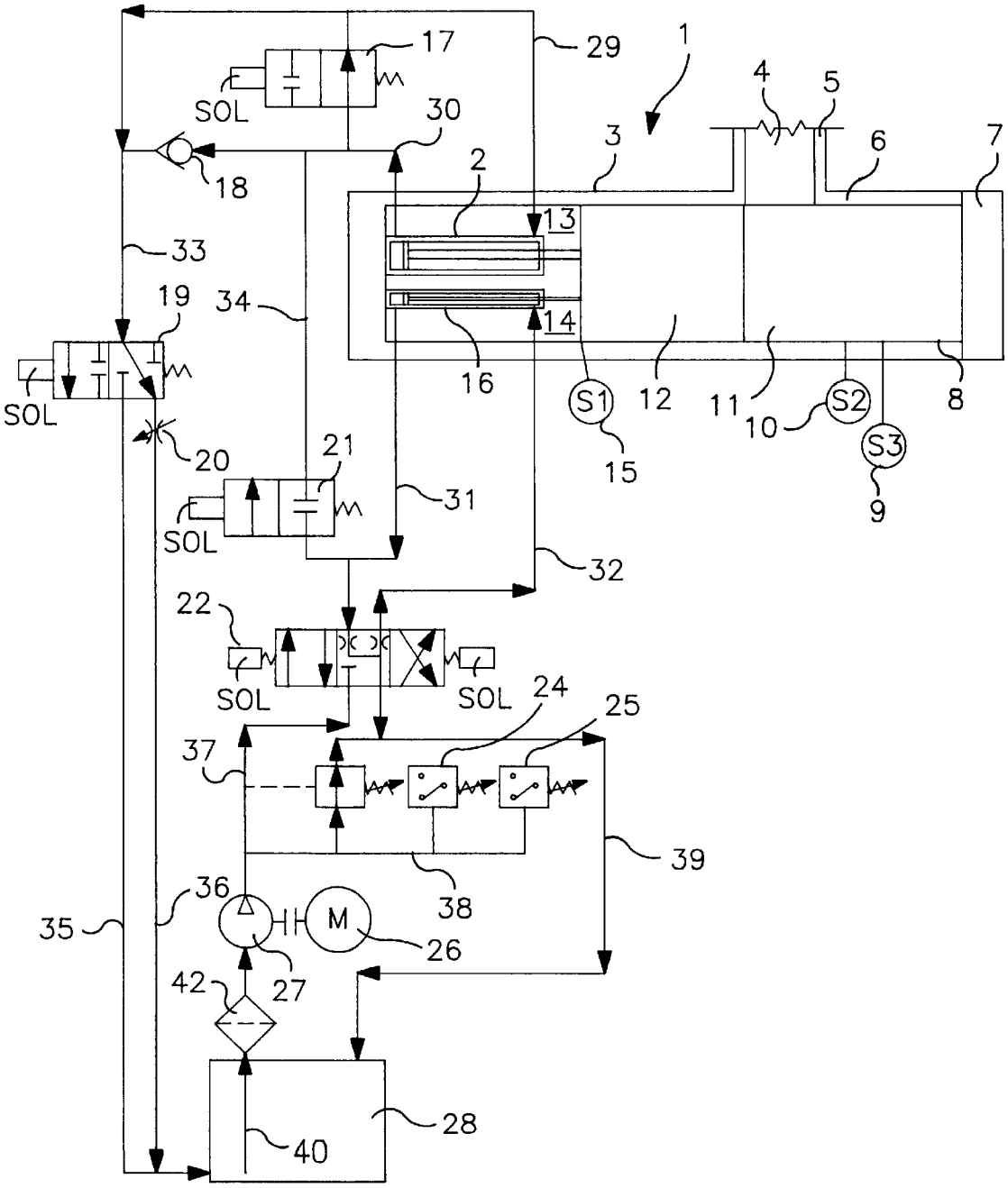
FIG. 6 is a schematic diagram of the baler of the invention in the retraction braking mode.

The platen 11 and associated moving paraphernalia have a great deal of mass, and it is necessary to brake its movement before it reaches the limit of cylinder strokes; otherwise damage might result to the cylinders when the moving equipment cause the pistons to strike the cylinder ends. Therefore, as shown in FIG. 6, valves 19 and 22 are configured to permit the cylinders to be used as hydraulic brakes. On retraction, when the platen reaches position switch S1 (15) it causes valves 19 and 22 to reposition. This stops the flow of the hydraulic fluid to both cylinders, and, furthermore, it inserts flow restriction orifices or valves in the lines to and from the secondary cylinder and the line from the primary cylinder. As a result, the moving platen 11 is quickly brought to stop. During this braking cycle, a pilot operated pressure relief valve 23 is caused to open by high pump discharge pressure, and all hydraulic fluid flow is shunted from the pump discharge back to the reservoir 28.

The present apparatus has the advantage that the hydraulic cylinder comprising the first compression may be actuated by the hydraulic cylinder comprising the second compression means. In such a case, hydraulic fluid flows into and out of the first hydraulic cylinder not motivated by a pump but rather by the moving piston inside of the first cylinder itself.

As seen in the drawings, valves are used in the hydraulic fluid piping system whereby the hydraulic cylinder comprising the first compression means receives hydraulic fluid from and discharges hydraulic fluid directly into the hydraulic fluid reservoir when the hydraulic cylinder of the second compression means is used in a fast mode utilizing all of the pressurized hydraulic fluid from the pump. The system also provides for the shunting of the hydraulic fluid directly from one end of the cylinder to the other end.

When more than two compression means are utilized, there is provided a smaller diameter ram for moving rapidly to actuate not only the platen but also the larger diameter ram or rams attached to the platen. Thereby, the larger diameter ram fills with and discharges hydraulic fluid so as to be instantly ready to actuate the platen when more pressure and a lower speed is required.

Figure 7:
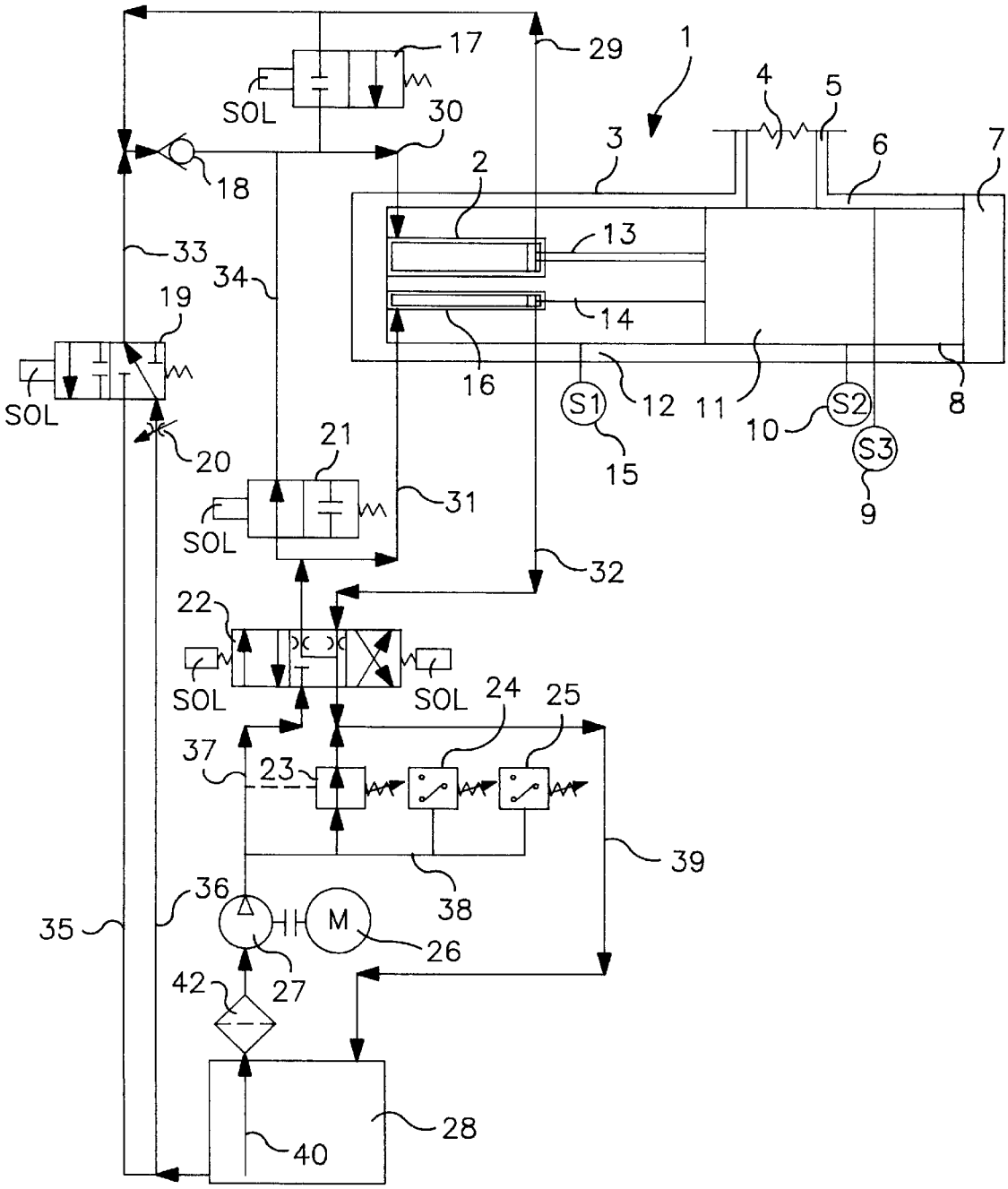
FIG. 7 is a schematic diagram of the baler of the invention in the compaction braking mode.

It may be necessary to also brake the platen in the compression direction, particularly during the first few cycles when there is little or no fiber in the compression chamber to resist the platen's movement. For this reason, as shown in FIG. 7, when the platen is extended to position switch S3 (9), solenoid valves 17, 19, 21 and 22 are positioned as shown and both the primary and secondary cylinders need flow restriction devices in their fluid supply or discharge. This causes the platen to be quickly braked to a stop prior to continuation of the baling cycle.

Typically a baler which is 28 inches high, 55 inches wide and 45 inches long can be utilized. In such a case, the compaction hydraulic pump typically delivers a pressure of about 3500 psi.

A typical combination of hydraulic rams would utilize two cylinders having systems that are 2 inches in diameter and one cylinder having a piston which is 5.5 inches in diameter. The extension rate of the two tramping cylinders using a total hydraulic fluid supply of 35 gpm would be 1.788 ft/sec. or 21.46 in/sec. On a power stroke where all the cylinders would be acting together, the total delivered force would be 105,444 lbs. and the extension rate would be 0.3738 ft/sec. or 4.485 in/sec. The retraction stroke, which is accomplished by the auxiliary cylinders alone, is faster than the extension stroke because the area of the piston acting in that direction is less by the area of the piston rod, in this case a 1 inch diameter. The velocity in retraction of the two inch cylinders acting together is 2.383 ft./sec. or 28.59 in./sec.

Another possible combination of cylinders would use one 5.5 inch diameter main cylinder and one 2.5 inch diameter auxiliary cylinder. This combination is possible, but design consideration utilizing bearings has to be given to the fact that the single auxiliary cylinder will generate an off-centered load on the platen. With this combination, the extension rate of the 2.5 inch diameter cylinder would be 2.288 ft./sec. or 27.46 in./sec. The retraction rate of the auxiliary cylinder which has a piston rod diameter of 1.75 in. would be 4.486 ft./sec. or 53.84 ft./sec. The force generated by the cylinders acting in tandem is 100,331 lbs. and the extension rate is 0.392 ft./sec.

Timed extensions and retractions of the hydraulic pistons can be controlled by a control means comprised of electrically actuated solenoid valves, each of which may be controlled manually or by a conventional programmable control or by standard relay logic as are known in the art and are, for example, as described in U.S. Pat. No. 4,936,206 which is herein incorporated by reference.

In the system, limit switches may be triggered when the pneumatic pistons are either extended or retracted. Specific logic combinations of limit switches statuses (on or off) trigger the energization of particular control relays, the contacts of which add further logic input for triggering other relays, solenoid valves and signal lamps on one or more graphic panels indicating the operational status of various components, can be employed so as to activate the hydraulic pumps.

It is also possible to provide, in addition to automatic controls, manual activation of the individual hydraulic cylinders for limited duty operation, testing, emergencies, etc.

Having illustrated and described the principles of the invention in several embodiments, it should be apparent to those skilled in the art that the invention may be modified in arrangement and detail from such principles.

What is claimed is:

1. An apparatus for compressing charges of compactable materials comprising a housing with a charge inlet, means in said housing defining a compression chamber, said chamber extending along a fixed axis and being defined by sidewalls, a rear wall and a platen movable along said axis defining a front wall;

a first compression means mounted in said housing attached to and extending from said platen for axially compressing a loaded charge of material a predetermined distance toward and against said rear wall, said first compression means comprising at least one hydraulic cylinder having a piston rod attached to and carried by said platen;

a second compression means mounted in said housing and attached to and extendable from said platen for axially tramping a loaded charge of material a predetermined distance toward and against said rear wall at a rate of speed faster than said first compression means, said second compression means comprising at least one hydraulic cylinder and piston rod connected to said platen, control means associated with said hydraulic cylinders and interconnecting said hydraulic cylinders with a hydraulic fluid reservoir for controlling a supply of hydraulic fluid under pressure to said hydraulic cylinders, and a hydraulic fluid piping system having valves whereby the hydraulic cylinder comprising said first compression means is valved so as to shunt hydraulic fluid directly from one end of the cylinder to the other end.

2. The apparatus of claim 1 including switch means associated with said second compression means for remotely signalling said piston rod to move forward and rearward and valve means automatically actuated by the movement of said second compression means to initiate movement of said first compression means.

3. The apparatus of claim 1 including means for additionally actuating said first compression means when the continued compacting movement of said second compression means is restrained by the compacted material beyond a preselected back pressure level, said first compression means being projected in advance of said second compression means to relieve said restraint so that compacting movement of said second compression means may be continued.

4. The apparatus of claim 1 wherein said second compression means is operable independent of said first compression means.

5. The apparatus of claim 1 wherein said second compression means comprises two hydraulic cylinders and piston rods.

6. The apparatus of claim 1 wherein said second compression means retracts said platen.

7. The apparatus of claim 1 wherein said first and second compression means have a common hydraulic fluid reservoir.

8. The apparatus of claim 1 wherein the hydraulic cylinder comprising said first compression means selectively can be actuated by the piston of the hydraulic cylinder of said second compression means whereby hydraulic fluid is permitted to flow into and out of said hydraulic cylinder of said first compression means.

9. The apparatus of claim 8 wherein said hydraulic fluid flows without the use of a pump.

10. The apparatus of claim 1 wherein said hydraulic cylinder of said first compression means receives hydraulic fluid from and discharges hydraulic fluid directly to the hydraulic fluid reservoir when the hydraulic cylinder of said second compression means is used in a fast mode.

11. The apparatus of claim 1 comprising more than two compression means, one of said compression means comprises a smaller diameter piston ram for rapidly moving the platen and a larger diameter piston ram.

12. An apparatus for compressing charges of compactable materials comprising a housing with a charge inlet, means in said housing defining a compression chamber, said chamber extending along a fixed axis and being defined by sidewalls, a rear wall and a platen movable along said axis defining a front wall;

a first compression means mounted in said housing attached to and extending from said platen for axially compressing a loaded charge of material a predetermined distance toward and against said rear wall, said first compression means comprising at least one hydraulic cylinder having a piston rod attached to and carried by said platen;

a second compression means mounted in said housing and attached to and extendable from said platen for axially tramping a loaded charge of material a predetermined distance toward and against said rear wall at a rate of speed faster than said first compression means, said second compression means comprising at least one hydraulic cylinder and piston rod connected to said platen, control means associated with said hydraulic cylinders and interconnecting said hydraulic cylinders with a hydraulic fluid reservoir for controlling a supply of hydraulic fluid under pressure to said hydraulic cylinders, a plurality of solenoid valves positioned to direct flow of hydraulic fluid to and from said hydraulic cylinders in a mode to cause said platen to move in a compacting direction, and one of said solenoid valves being a three position, four connection spring-centered solenoid valve positioned to direct flow of hydraulic fluid to and from the hydraulic cylinders to cause said platen to move in a compression direction, and said solenoid valves are configured to permit said cylinders to be used as hydraulic brakes.

13. The apparatus of claim 12 including pressure sensing switches for activating said solenoid valves at preselected pressures.

* * * * *